United States Patent [19]

Woodcock

[11] Patent Number: 4,761,029

[45] Date of Patent: Aug. 2, 1988

[54] SKI BOOT CARRIER

[76] Inventor: Edward J. Woodcock, 52 Concord St., Providence, R.I. 02904

[21] Appl. No.: 91,405

[22] Filed: Aug. 31, 1987

[51] Int. Cl.[4] ..... B65D 63/18

[52] U.S. Cl. ..... 294/148; 294/163; 294/166; 294/169

[58] Field of Search ..... 294/137, 146, 148, 149, 294/151, 153, 159, 162–167, 169; 12/120.5; 211/34, 35, 37, 38; 224/250

[56] References Cited

U.S. PATENT DOCUMENTS

| | | | |
|---|---|---|---|
| 3,608,795 | 9/1971 | Klein et al. | 294/148 |
| 4,537,436 | 8/1985 | Pfortmiller | 294/148 X |
| 4,624,496 | 11/1986 | Bengtson | 294/148 |
| 4,629,103 | 12/1986 | Miller | 224/250 |
| 4,696,504 | 9/1987 | Roberts | 294/148 |

FOREIGN PATENT DOCUMENTS

| | | | |
|---|---|---|---|
| 2916392 | 11/1980 | Fed. Rep. of Germany | 294/165 |

*Primary Examiner*—Johnny D. Cherry
*Attorney, Agent, or Firm*—Robert J. Doherty

[57] ABSTRACT

A device for carrying a pair of boots such as ski boots in which a rigid frame is connected to an elongated rod-like carrying member such that the carrying member divides the frame member into two receiving pockets that in turn receive and retain the forward ends of the boots. The carrying member extends upwardly between the boots and terminates in a handle for carrying the resultant package. The upper ends of the boots are restrained by an elastic member which is connected at one end to the carrying member and is adapted to at least partially engage upper outer portions of the boots to retain them in a stable position.

10 Claims, 3 Drawing Sheets

SKI BOOT CARRIER

BACKGROUND AND OBJECTS OF THE INVENTION

This invention relates to a carrier for a pair of boots such as ski boots. Ski boots as well as other boots present a problem because they are bulky and generally worn during activities when it is desirable to have one hand free to aid in maneuvering oneself or to carry other equipment. Thus, it is desirable to be able to hold both ski boots with one hand in a convenient package. It should also be pointed out that while this invention will be described in relation to the term ski boots, other boots and athletic equipment are also encompassed by such term.

The above problem has generally been recognized and several attempts have been made and equipment provided to initially secure and thereafter carry ski boots with one hand. The present applicant is aware of the device shown and described by U.S. Pat. No. 4,629,103 dated Dec. 16, 1986 in which a ski boot carrier in the form of a panel adapted to be inserted between a pair of ski boots is utilized as the plate from which a series of straps is utilized to encircle the boots in various attitudes and to further provide a carrying handle therefore. While useful, such device requires extensive manual dexterity and strap threading around and between boots which could to many people present a cumbersome task especially in cold weather and snowy conditions. It should also be pointed out that the above-mentioned patent also discusses a number of alternate boot carriers under the "Description of the Prior Art" heading and such descriptions in U.S. Pat. No. 4,629,103 are herewith incorporated into this application by specific reference.

Another device which reprsents an attempt to provide a convenient and easily utilized ski boot carrier is that shown in U.S. Pat. No. 4,537,436 dated Aug. 27, 1985. Such patent describes a device in which a series of flexible rope loops are utilized to surround the lower and upper paired boot portions to povide for their assembly and carrying. Such device, however, lacks the rigidity and feel of secureness that is inherently desirable in a device of this nature.

Accordingly, the need for a convenient, easily utilizable, secure feeling, and relatively inexpensive and easily stored device when not in use is present. These and other objects of the present invention are accomplished by a device for holding and carrying boots such as ski boots comprising a substantially rigid upright hollow frame adapted to receive the forward portions of a pair of said boots aligned side by side, said frame including a bottom run adapted to engage the soles of said pair of boots and an upper run adapted to engage upper forward portions of said pair of boots, a substantially rigid elongated carrying member having upper and lower ends, said upper end having a gripping handle at said upper end and connected to said frame at the lower end, said carrying member extending upwardly rearwardly from said lower frame run to essentially divide said frame into individual boot receiving sections and adapted to extend upwardly between said pair of boots, and means for restraining the upper portions of said pair of boots connected to said member proximal the upper end thereof.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DETAILED DESCRIPTION OF THE INVENTION

Figure 1:
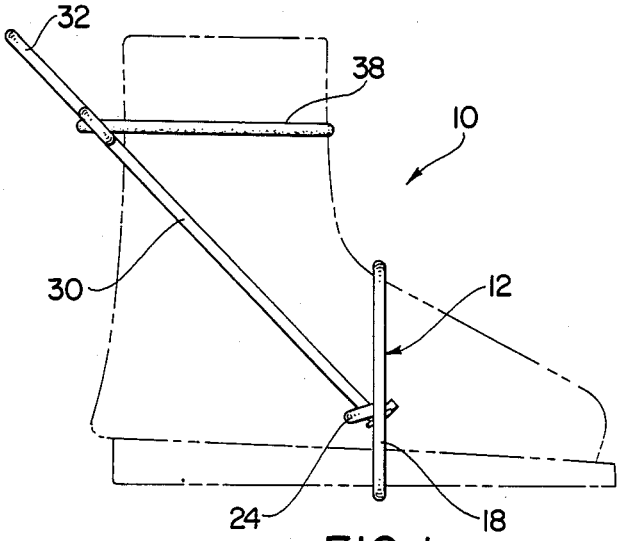
FIG. 1 is a side elevational view of one form of the invention disposed in a use position about a pair of ski boots.
Figure 2:
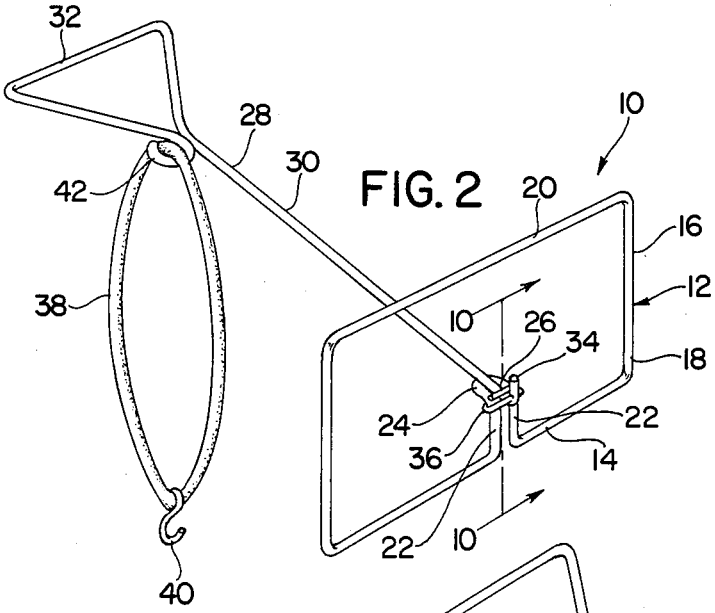
FIG. 2 is a perspective view showing the device in use position but without the ski boots inserted therein.
Figure 10:
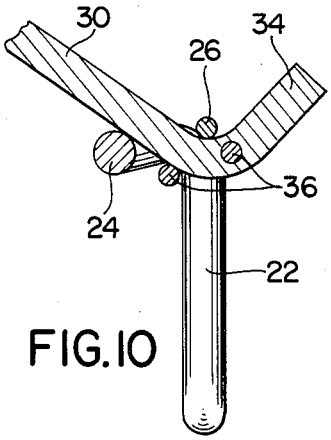
FIG. 10 is a partial cross-section along line 10—10 of FIG. 2 showing the manner in which the handle and frame shown in FIGS. 1–3 and 6–9 interrelate in the use position.
Figure 3:
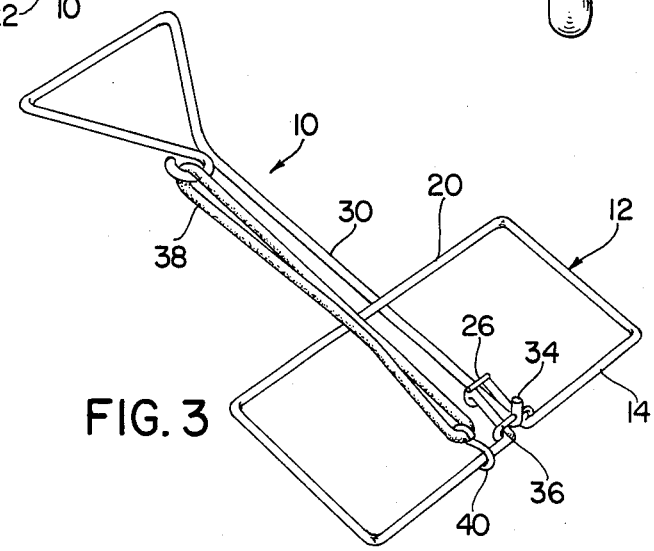
FIG. 3 is a perspective view similar to FIG. 2 but showing the device in its storage or non use position.

Turning now to the drawings and particularly FIGS. 1 through 3 thereof, one form of the ski boot carrying device 10 of the present invention is shown. Therein a pair of ski boots are shown in phantom in side to side relationship with each other and retained within the device 10 in the desired manner. Such device includes a hollow tubular frame 12 of generally rectangular configuration and including a lower run 14 and an upper run 16 composed of side and top members 18 and 20 respectively. The central portion of the lower run 14 is interrupted by a pair of upstanding legs 22. The upper end of the legs 22 terminates in a generally U-shaped loop 24 which inwardly extends therefrom. The normally open loop base is closed by a bar 26.

A carrying member 28 is adapted for positioning between the pair of boots and for attachment to the frame 12 via a connection with the lower run 14 thereof. The carrying member 28 includes a central rod-like shaft 30 which terminates at its upper end in an appropriately shaped handle 32. The lower end of the shaft 30 terminates in an upwardly extending hook 34. The lower end of the shaft 30 extends through the loop 24, and the hook 34 extends upwardly between the legs 22 in slidable engagement therewith. A keeper link 36 attached to the hook 34 encircles the legs 22 to insure that the lower end of the rod 30 will not become detached from its connection to the frame.

The upper end of the rod 30 is provided with a ring-shaped elastic cord 38 having a ring-shaped hook 40 clenched at one end thereof. The other end of the cord is appropriately attached to the handle as by a reversed curved terminal portion 42 or any other suitable means. It should be pointed out that the cord forms the restraining means for upper portions of the boots in the device's use position, that is, in such position, the cord is adapted to extend around the tops of both boots. Additionally in such use position, the rod is slid back to its rearwardmost position as shown in FIGS. 1 and 2 of the drawing wherein the hook 34 engages the bar 26, and the lower portion of the rod 30 engages the loop 24 to position the carrying means in an attitude which extends upwardly and rearwardly vis-a-vis the frame 12 and in a position between the pair of boots such that the weight is evenly distributed on both sides of the device for carrying ease.

Also inasmuch as the frame 12 and the carrying member 28 are rigid, i.e., generally formed of metallic rod-like members, the boots are held in a generally, inasmuch as practical, fixed position, that is, they are both weight distributed vis-a-vis the handle 32 and stabilized in position such that the device not only serves as a convenient way by which the boots may be transported but also temporarily stored as by hanging upon a wall or even placed on the ground. The preferable position for the handle 32 in the use position of the device is slightly to the rear and slightly above the rear edge of the upper portions of the boots, although such position depends on the size and shape of the boots being transported and could be changed from device to device—an important aspect in this regard being that the rod extends upwardly between the boots and, in essence, divides the frame 12 into two component parts in which the toes or front boot ends are each received. It is this frame engagement with the boots as well as the cord engagement with the boots that immobilizes such. As will be seen, the boot soles rest upon the lower run 14 while the upper run 16 engages the upper portions of the front areas of the boot pairs.

When it is desired to place the device in a non use position, the boots are simply removed therefrom, and the rod slid forwardly such that the securing link 36 engages the lower run 14 wherein the carrying member 28 and the frame 12 are generally disposed in the same plane. Thereafter, the cord 38 is extended such that the S-shaped hook 40 engages the lower run and, accordingly, maintains the carrying member 28 in its forward position as shown in FIG. 3.

Figure 7:
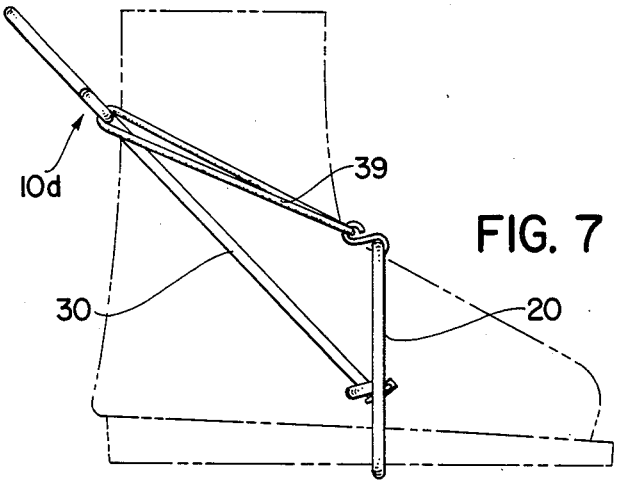
FIG. 7 is a side elevational view similar to FIG. 1 showing another form of the invention.
Figure 8:
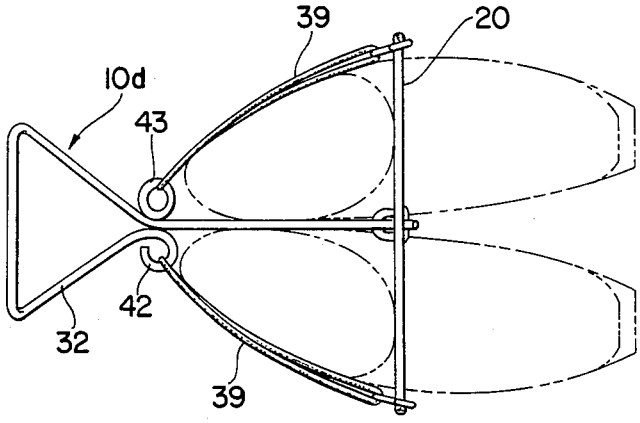
FIG. 8 is a top plan view of the device shown in FIG. 7.
Figure 9:
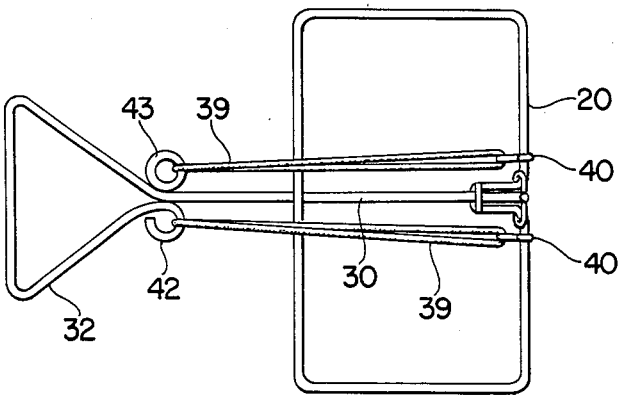
FIG. 9 is a view similar to FIG. 3 showing the device shown in FIG. 7 in its storage or non-use position.

Turning now to FIGS. 7 through 9, another form of the device **10*d* is shown which is particularly preferred whn utilizing lower topped boots than conventional ski boots or when extension of the closed loop cord 38 around the boot tops requires too much strength or effort. In this modification, the cord 38 is replaced by a pair of straight cords 39 each connected at one end to the handle 32 as at the reverse curved terminal portion 42 as well as a separate ring 43 and having a ring-shaped hook 40 at its opposite end. When placing the device 10*d* in operational position, everything functions as in the device 10 previously explained above except with respect to the way the tops of the boots are restrained. In this case, the individual cords 39 run in opposite outside portions ofthe boots, that is, around the outsides of the boots from the thin handle connection to the upper run 20 of the frame 12. The rings 40 engages the upper run 20 at spaced points along the length thereof and in this way restrain the tops of the boots from excess lateral movement. Generally, the cords 39 are of a length that insures contact with the outside side portions of the upper parts of the boots. This modified form of cord restraint as compared with cord 38** enables boots with lower tops to be easily restrained and also reduces the strength needed to place the cord in operative position.

Figure 4:
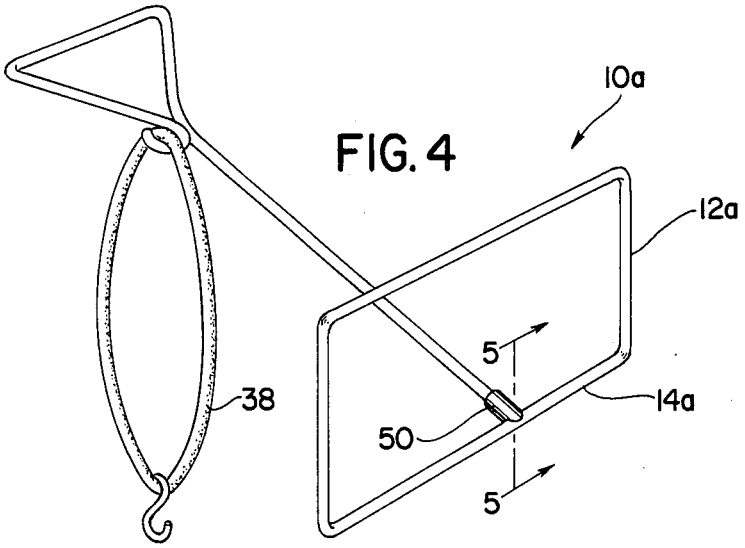
FIG. 4 is a perspective view similar to FIG. 2 but showing an alternate form of the device.
Figure 5:
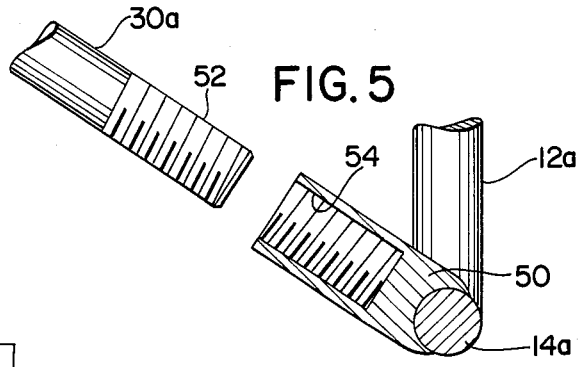
FIG. 5 is sectional view on an enlarged scale along the line 5—5 of FIG. 4.

Turning now to FIGS. 4 and 5, another modified form of the device **10*a* is depicted. Therein the frame 12*a* does not include the upstanding legs to accommodate use and non use positions but is provided with a threaded boss 50 attached to the lower run 14*a* centrally thereof and disposed at a upward rearwardly inclined position. The boss 50 is welded or otherwise fixedly connected in such position to the lower run 14*a*. The lower end of the rod 30*a* is provided with a threaded connection 52 adapted for receipt into the threaded bore 54 of the boss 50. Thus in the non use position of the device 10*a* shown in FIGS. 4 and 5, the rod 30*a* would simply be unscrewed from the boss, and the two pieces stored flat. Otherwise, the operation of the device in the use position shown in FIGS. 4 and 5 is essentially the same as that described in the previous embodiment depicted in FIGS. 1 through 3**.

Figure 6:
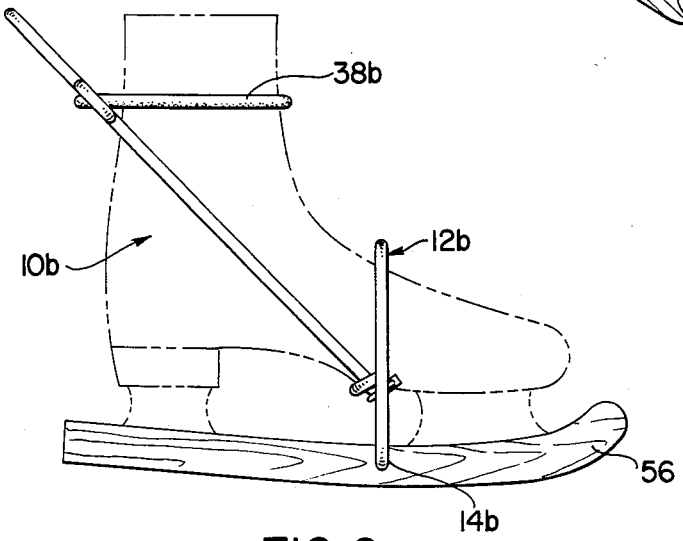
FIG. 6 is an elevated view of a modified form of the device similar to FIG. 1 and specially adapted for ice skates.

A further embodiment of the invention is shown in FIG. 6 wherein the device as shown in FIGS. 1 through 3 may be provided with a pair of blade protectors 56 into which a pair of ice skate blades are adapted to extend into grooved slots provided in the upper face of the protectors 56. Such protectors could take the form of more pliable cap-like structures, but in either event, the essential feature being that the protectors 56 are pivotally engaged to the frame **12*b* by having the lower run 14*b*** thereof extending through the bodies of the pair of side to side position protectors. In this way then, a carrying device which includes inherently built-in protectors is provided for ice skates and other devices having blades or wheels which could damage those or surfaces which they contact or they themselves must be protected from abuse.

Accordingly, a new, useful, easily carried, and easily stored device of moderate cost is provided to accomplish the objects of the present invention.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A device for holding and carrying boots such as ski boots comprising a substantially rigid upright hollow frame adapted to receive the forward portions of a pair of said boots aligned side by side, said frame including a lower run adapted to engage the soles of said pair of boots and an upper run adapted to engage upper forward portions of said pair of boots, a substantially rigid elongated carrying member having upper and lower ends, said carrying member having a gripping handle at said upper end and connected to said frame at the lower end, said carrying member extending upwardly rearwardly from said lower frame run so as to essentially divide said frame into individual boot receiving sections and adapted to extend upwardly between said pair of boots, and means for restraining the upper portions of said pair of boots connected to said carrying member proximal the upper end thereof.

2. The device of claim 1, said means for restraining the upper portions of said boots being a ring-shaped elastic cord which encircles the upper boot portions in its carrying position.

3. The device of claim 1, said frame being generally rectangular.

4. The device of claim 1, said means for restraining the upper portions of said boots being a pair of elastic cords connected to the handle at their upper ends and each having a hook at their lower ends, said hooks engaging the frame upper run at laterally space locations and said cords extending across lateral outside portions of said boot upper portions

5. The device of claim 1, said carrying member connected to said frame for movement between a first collapsed storage position where said member and said frame are in generally co-planar relationship and a second position where said member extends upwardly rearwardly therefrom in a fixed use position.

6. The device of claim 5, said means for restrainng the upper portions of said boots being an elastic ring, said ring including hook means for engaging said lower run so as to maintain said carrying member in said storage position with said ring extended across said frame.

7. The device of claim 5, said means for restraining the upper portions of said boots being a pair of elastic cords, said cords having hook means for engaging said lower run so as to maintain said carrying member in said storage position with said cords extended across said frame.

8. The device of claim 5, said lower run including an upstanding pair of closely spaced legs co-planar with said frame and terminating in a rearwardly extending generally U-shaped loop including a closed head and an open base and having a stop bar extending across said base, said carrying member terminating at its lower end in an upwardly extending hook, said hook positioned between said legs with said member extending through said loop with said member upwardly slidable from said first position to said second position where said hook contacts said bar and said member contacts the head of said loop to fix the member in its use position.

9. The device of claim 1, said member fixably and threadably connected to said lower run.

10. The device of claim 1, said lower run including a pair of pivotally mounted blade receiving runners positioned at right angles to the plane formed by said frame.

* * * * *